United States Patent [19]

Drazy

[11] Patent Number: 4,899,799

[45] Date of Patent: Feb. 13, 1990

[54] HELICAL COMPRESSOR AND METHOD OF MAKING SAME

[76] Inventor: Norman A. Drazy, 1927 E. Duke Dr., Temple, Ariz. 85283

[21] Appl. No.: 364,618

[22] Filed: Jun. 9, 1989

Related U.S. Application Data

[62] Division of Ser. No. 204,341, Jun. 9, 1988.

[51] Int. Cl.[4] ..... B22C 4/04

[52] U.S. Cl. ..... 164/34; 164/44; 164/45; 164/137

[58] Field of Search ..... 164/34, 35, 36, 45, 164/137, 246, 249, 44; 29/156.4 C

[56] References Cited

U.S. PATENT DOCUMENTS 4,761,124 8/1988 Timuska et al. ..... 418/201 B
4,790,367 12/1988 Moll et al. ..... 164/34

FOREIGN PATENT DOCUMENTS 59-232810 12/1984 Japan ..... 164/137
60-187447 9/1985 Japan ..... 164/34

*Primary Examiner*—Richard K. Seidel
*Attorney, Agent, or Firm*—Gregory J. Nelson

[57] ABSTRACT

A helical compressor having hollow male and female rotor components of the type used as a supercharger for an internal combustion engine. The compressor is provided with a manifold plate which cooperates with the manifold to evenly distribute the high pressure discharge from the compressor throughout the associated plenum or manifold. The hollow rotor components are cast by full mold casting techniques in which an expendable foam pattern is first made in a metal mold and then placed in a sand-filled flask and poured with an appropriate foundry metal. The interior and exterior surfaces of the rotor pattern parts having helically extending lands and grooves permitting helical ejection of the pattern parts from the mold.

4 Claims, 5 Drawing Sheets

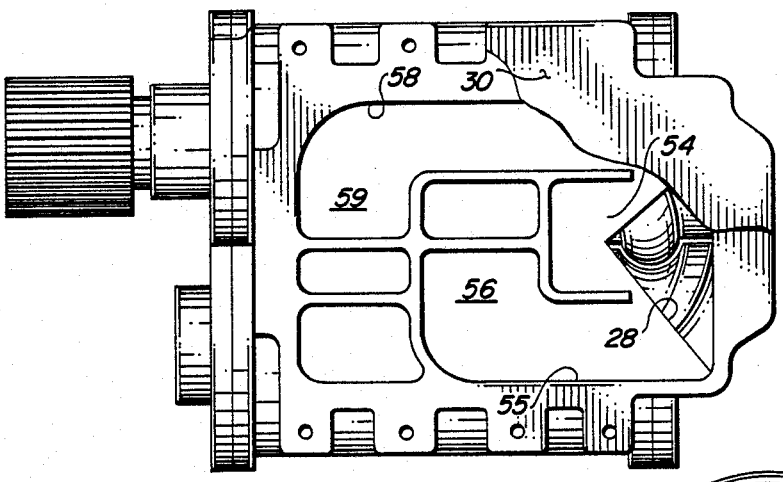
FIG. 3A
FIG. 4
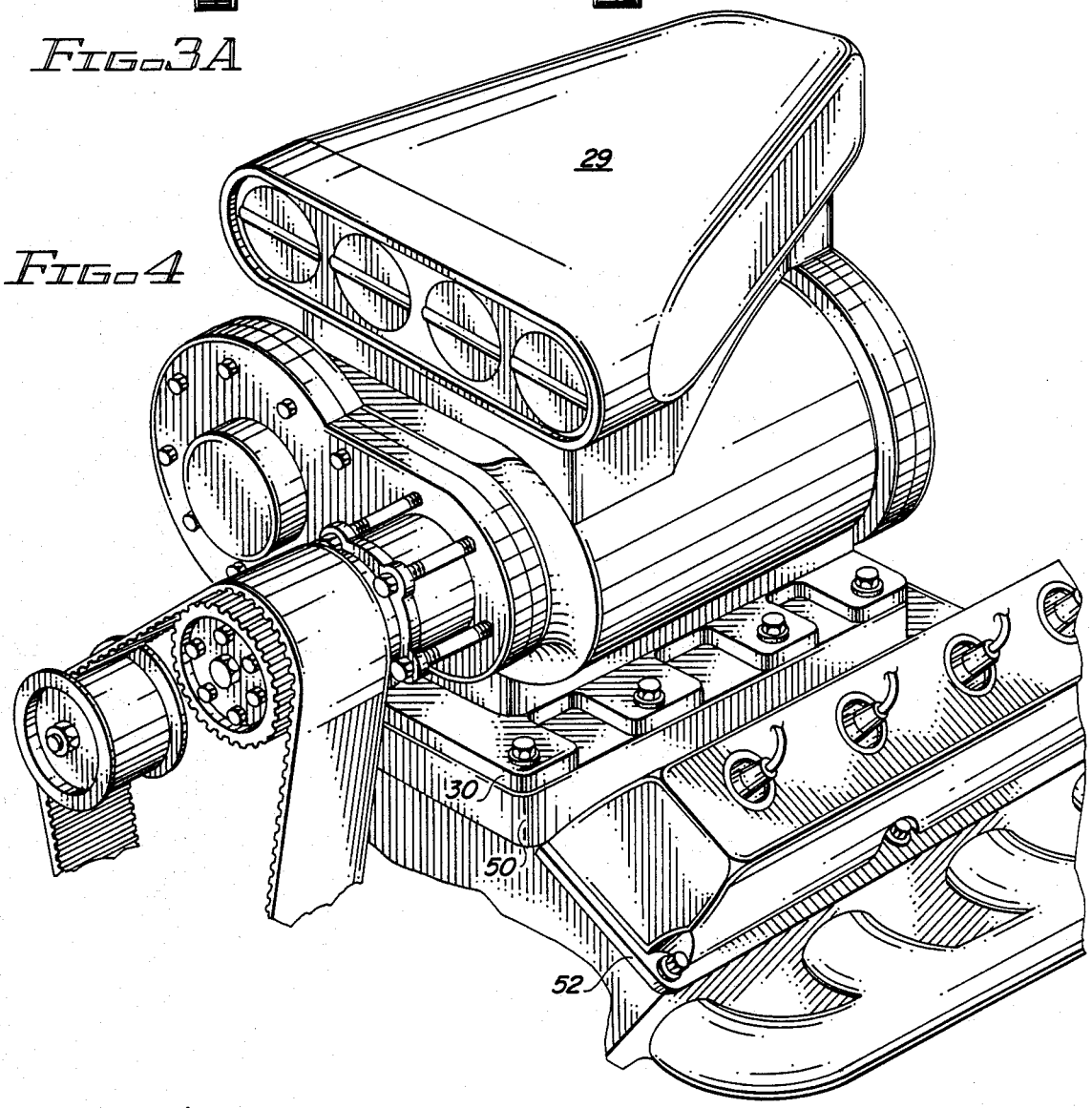

FIG. 5
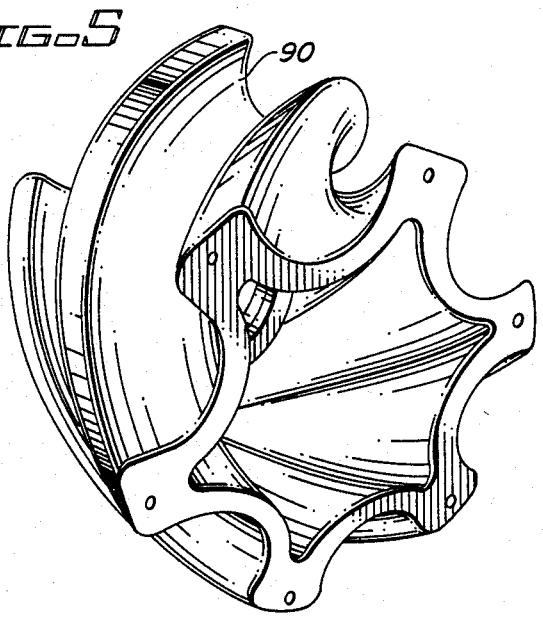
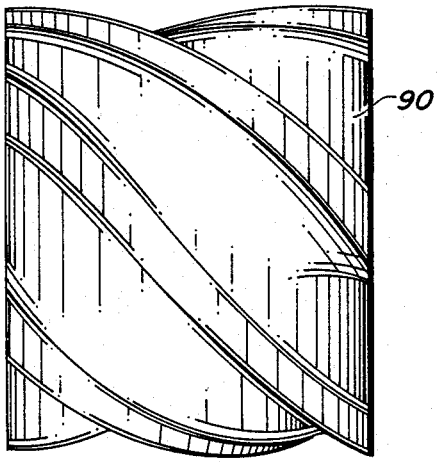
FIG. 7
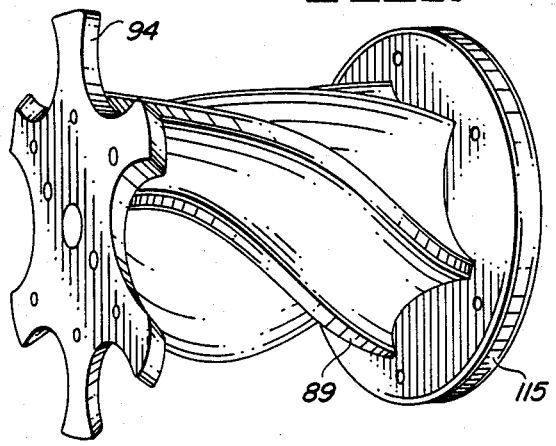
FIG. 6
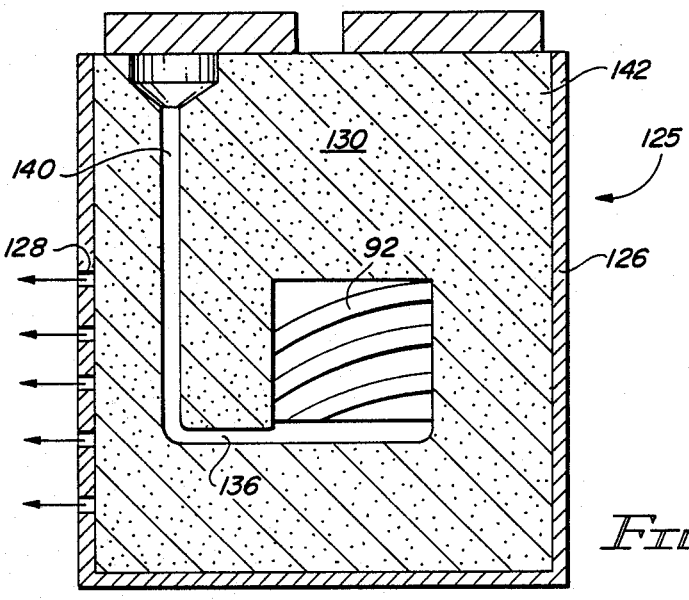
FIG. 8

COMPRESSOR EFFICIENCY

HELICAL COMPRESSOR AND METHOD OF MAKING SAME

This is a divisional application of application Ser. No. 204,341, filed June 9, 1988.

The present invention relates to rotary devices and more particularly to compressors of the helical or screw-type having inter-meshing lobed male and female rotors and to the manufacture of such devices.

Various types of rotary devices which operate on air and other compressible fluids are found in the prior art. Generally these devices have counter-rotating, intermeshing rotors with lands and lobes and one well-known device of this type is the Roots blower or supercharger. A Roots supercharger is a positive displacement pump in which the volume of air moved is directly proportional to the speed at which the device is driven. Roots superchargers generally have either two or three-lobed rotors which receive ambient air from an intake port and discharge the air through an outlet port. Since the Roots-type device is a pump, no internal compression of the fluid takes place through the unit although pressure may increased during discharge into an associated plenum or manifold.

One of the main applications for a Roots-type supercharger is as a booster device for delivering increased volumes of air and fuel to internal combustion engines. The purpose of the Roots blower or supercharger in such applications is to increase the volumetric efficiency of the engine by forcing an increased quantity of the air/fuel mixture into the cylinders than can occur at atmospheric pressure.

A Roots blower is very efficient for moving large volumes of air but such a device is not well suited for increasing pressure. Further, when operated at high pressure ratios, Roots blowers suffer leakage problems and are not particularly efficient, requiring substantial power. In the application as a supercharger for an internal combustion engine, the horsepower loss is significant particularly in the case of a high performance dragster or racing engine in which the manifold pressure is generally maintained at several atmospheres.

Another type of device for compressing air which overcomes some of the disadvantages of the Roots-type blower is the screw compressor. A screw compressor has a pair of cooperating rotors, one having male lobes and the other female grooves or valleys, which are axially aligned and mesh upon rotation forming moving compression chambers of progressively smaller volume which compress the air or other fluid. Compressors of this type possess a number of advantages including smoothness and quietness of operation as well as simplicity. A typical helical rotary device of the general type is shown in the patent to Nilsson, U.S. Pat. No. 2,622,787. This patent describes a device having a casing defining both inlet and outlet ports. The rotors are of the male and female type in which the helical lobes are at maximum volume when in communication with the inlet port and at reduced volume when in communication with the outlet port. Compression commences when the lobe of one rotor enters the filled groove of the other and compression continues until the grooves come into communication with the outlet port initiating the discharge phase of the cycle. The patentee suggests an improved profile for the rotor lands and rotor grooves which provides a shorter sealing line between the rotors than exist with the prior art.

The male and female rotor components of the Nilsson device are shown as being substantially solid. typically these rotors are fabricated by machining the lobes and grooves from a piece of solid stock. Obviously such a procedure is extremely labor-intensive. Material used may be iron, bronze, steel or in some cases aluminum or lighter alloys.

Rotor components which are solid have substantial weight and inherently high inertia requiring substantial starting torque. Operation at high speeds with the heavy rotating mass of such devices imposes substantial centrifugal structural loads upon the internal rotor structure particularly the male rotor which commonly operates at one and one-half times the speed of the female rotor. Solid components are not particularly suited for applications requiring light weight and low inertia such as a supercharger which operates at high rotary acceleration.

To overcome the inherent deficiencies of solid rotor designs, the prior art suggests a rotary device which is a fabrication of rotors of built-up construction from parts so that the rotor lobes as well as the central part of the rotor are hollow. Patent No. 2,325,617 suggests fabricating the lobe portion of the rotors from series of laminations of relatively thin material. The laminations are die stamped from a suitable material which must be assembled on a central sleeve. The patentee also suggests making the rotors of die cast sections and a plurality of sections are assembled by a locking arrangement.

Another approach to the manufacture of a hollow rotor design is shown in U.S. Pat. No. 2,714,314. In this patent, the male and female rotor components are formed from sections of pressed metal welded to a tubular hub.

While the aforementioned patents recognize the advantage of providing lighter weight, hollow rotor compressors, such designs have not as a practical matter achieved acceptance in the industry. Rotors of this type remain difficult to fabricate and the critical tolerances required in high-speed devices of this type are difficult to maintain by the manufacturing methods suggested in the prior art. Leakage problems, cost and reliability are a problem with prior art hollow compressor designs. Further, these designs require that both the male and female rotor be fabricated on a sleeve or hub which adds to the weight of the device.

Briefly, the present invention provides a helical compressor and method of fabricating the rotor components using full mold casting techniques. A metal mold defining a cavity in the shape of the rotor part is filed with pre-expanded polystyrene beads and the mold is heated causing the contained polystyrene beads to further expand. The resulting component of molded foam is removed from the mold after a cooling period and forms a foam pattern. The foam pattern is coated with gas-permeable refractory material and is placed in a flask in a generally vertical position. The flask is filled with free-flowing sand which is packed around the exterior and into the interior of the pattern. Appropriate gating either as an integral part of the element or separately attached to the pattern provides a pathway for molten metal. The molten metal vaporizes the foam pattern and occupies the interior of the refractory material. After cooling, the solidified casting is removed and any finishing assembly steps may then be accomplished.

The present invention also encompasses a discharge port and manifold plate arrangement for a supercharger for an engine which incorporate a plurality of flow passages to deliver the compressed fluid in an even distribution pattern to a manifold plenum communicating with the inlet port runner of the engine.

The above and other objects and advantages of the present invention will be more fully understood from a consideration of the following specification taken in conjunction with the drawings in which:

FIG. 3A is a bottom view of the compressor with the manifold plate partly broken away;

FIG. 4 is a perspective view of the compressor mounted on an engine including the manifold plate assembly;

FIG. 5 is a perspective view of a typical expendable polystyrene pattern used for fabricating a female rotor component;

FIG. 6 is a side view of the pattern shown in FIG. 5;

FIG. 7 is a perpsective view of the female mold core and pusher plate used in making the pattern shown in FIGS. 5 and 6;

FIG. 8 is a cross-sectional view of the pattern and flask assembly;

Figure 1:
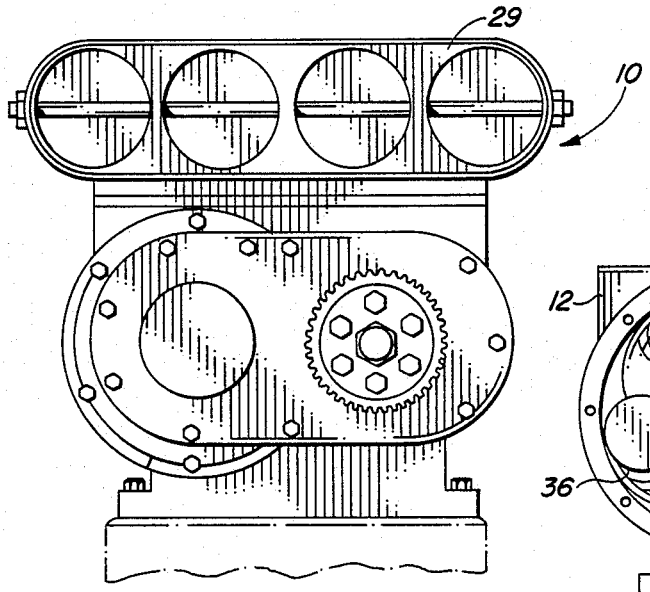
FIG. 1 is a front view of a compressor, a rotary device according to the invention.

Referring to the drawings, particularly FIGS. 1 to 4, a screw compressor 10 is shown. The device includes a housing 12 defining two generally cylindrical, parallel and intersecting bores 14 and 16, each receiving a rotor. End plates 18 and 20 are provided at the front and rear of the chambers and house suitable bearing members for rotatively mounting the rotors. The device is driven through a pulley or gear 24 coupled to one of the rotors. In the case of an automotive supercharger, the rotors are typically driven at approximately 12,000 RPM from the crankshaft.

In the embodiment shown, housing 12 has an inlet port 26 and an outlet port 28. Inlet port 26 extends generally radially communicating with ambient surroundings to draw in air. The outlet port 28 extends generally radially in the housing disposed on the opposite side and end of the housing so that the pressurized discharge from the rotors is directed downwardly at the rear of the housing. When the device is to be used as a supercharger in connection with an internal combustion engine, outlet port 28 discharges through passages formed between the housing and a manifold plate 30 to direct flow to a manifold 50 connecting with the individual engine cylinders in known fashion. The inlet port is associated with an intake section 29 for directing and throttling air to the inlet port. The details of the lower housing and manifold plate 30 will be described hereafter.

Rotors 32 and 34 are shown as being a male and female rotor, respectively. The male rotor 32 has helically extending lands 36 which are generally convex in cross section. The female rotor 34 has generally concave grooves 38. In the structure shown, the female rotor 34 has six grooves and the male rotor four lobes or lands which mesh to form the progressively volumetrically decreasing compression chambers. The number of grooves and lands may vary depending on design and operational characteristics. The ends of the rotors are fitted with stub shaft assemblies which are structurally affixed and are rotatively journaled in bearing assemblies and appropriate shaft sealing elements at the opposite end plates 18 and 20.

A plurality of compression chambers 40 are formed by the mating rotor lobes or lands 32 and the rotor grooves 34. The rotors 32, 34 are appropriately geared so that the two rotors mesh without contacting one another. The rotors rotate in opposite directions and in close proximity to the internal walls of chambers 14 and 16. As the rotors rotate, compression chambers 40 sequentially open to full volume and draw in air while in communication with the inlet port 26. The compression phase commences when the lands of rotor 32 enter the filled grooves 38 of rotor 34. Due to the helical configuration of the rotors, the length and volume of the chambers 40 decrease from inlet to outlet and with the decrease in volume, the internal pressure in each chamber is increased. Compression chambers 40 are axially displaced towards the outlet port 28 and are sequentially brought into registration with the outlet port 28. The outlet discharges compressed fluid radially downwardly to be distributed by the passages defined between the housing and manifold plate 30 to the subjacent manifold 50.

Figure 2:
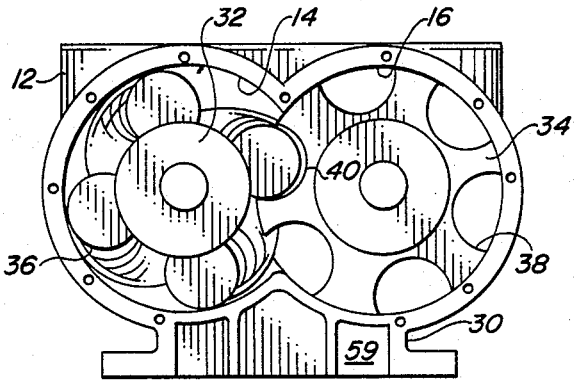
FIG. 2 is a sectional view taken along lines 2—2 of FIG. 1A.

The lobes and grooves of the rotors are preferably symmetrical in profile and as best seen in FIG. 2, the outer or crest portions of the male lobes 36 being of generally circular configuration while the female grooves 38 are of like circular section. In practice, some deviations from symmetrical circular profile may be desirable for more effective sealing between the rotors. In accordance with the invention, the female rotor 34 is hollow with the internal cavity 35 conforming to the general shape of the exterior of the rotor without a weight increasing central sleeve or tube. The central or core 39 of the male rotor 32 is also hollow with hollow lands or lobes having a substantially uniform wall thickness. The unique hollow rotor construction and method are set forth in detail below.

In conventional superchargers uneven fuel distribution is a known problem. Roots superchargers do not compress air; instead ambient air is delivered to the manifold at a flow rate higher that can be accomodated by the engine and a pressure increase results. Backflow pulses occur when ambient pressure air carried in the rotor lobespaces encounters the higher pressure manifold air at discharge. With conventional Roots blowers, uneven fuel distribution occurs when the rotor mesh traveling forward pushes the air, which includes a vaporized fuel charge to the front of the discharge port. The fuel and air then circulates through the manifold to the rear, which due to the backflow pulses which originate at the rear of the outlet port due to the helical nature of Roots rotors, create a low pressure zone. As the air flow turns to re-enter the supercharger, liquid fuel tends to condense due to the rapid backflow decompression and enter the rear two intake runners. Because of this, the front engine cylinders tend to receive a leaner fuel/air mixture and the aft cylinders a richer mixture.

Figure 1A:
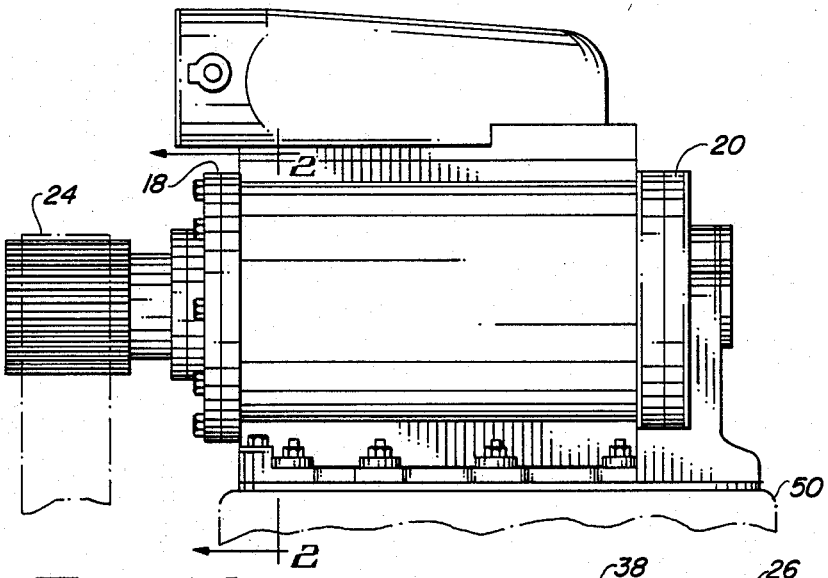
FIG. 1A is a side view.
Figure 3:
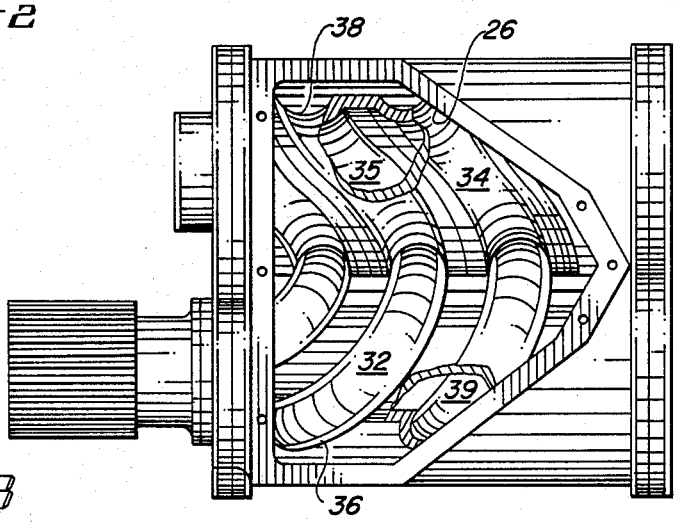
FIG. 3 is a top view.

The present invention provides a discharge manifold assembly including a manifold plate which alleviates the problem of uneven discharge. As best seen in FIGS. 1A and 4, the compressor housing 12 is located on a manifold 50 which in the case of a supercharger delivers fuel and air to the cylinders of an engine 52. Interposed between the manifold 50 and the rotor housing is a manifold plate 30. The air is drawn into the rotor mesh at inlet port 26 and is downwardly discharged at outlet port 28.

As seen in FIG. 3A, port 54 communicates with the outlet port 28 of the compressor. Port 54 also communicates directly with the subjacent manifold 50 through the plate 30. Axial passage 55 communicates with port 28 extending along one side of the manifold terminating at port 56 which communicates with the manifold through plate 30 at an intermediate and generally central location. Axial passage 58 communicates with port 28 extending axially along the side of the manifold opposite passage 55. Passage 58 communicates with manifold 50 through plate 30 at a forward and generally central location at port 59. The ports 54, 56 and 59 are approximately equal in area and distribute the air/fuel mixture or other fluid evenly along the length of the associated manifold 50 introducing the compressed fluid mixture at fore, aft and intermediate locations, thus overcoming the problems of localized and uneven distribution. As shown, the passageways may be formed in either the upper surface of the manifold plate 30 or in the lower housing section or partially in both. In any case, the housing and manifold plate serve to evenly distribute the compressed fluid and fuel mixture.

Figure 9:
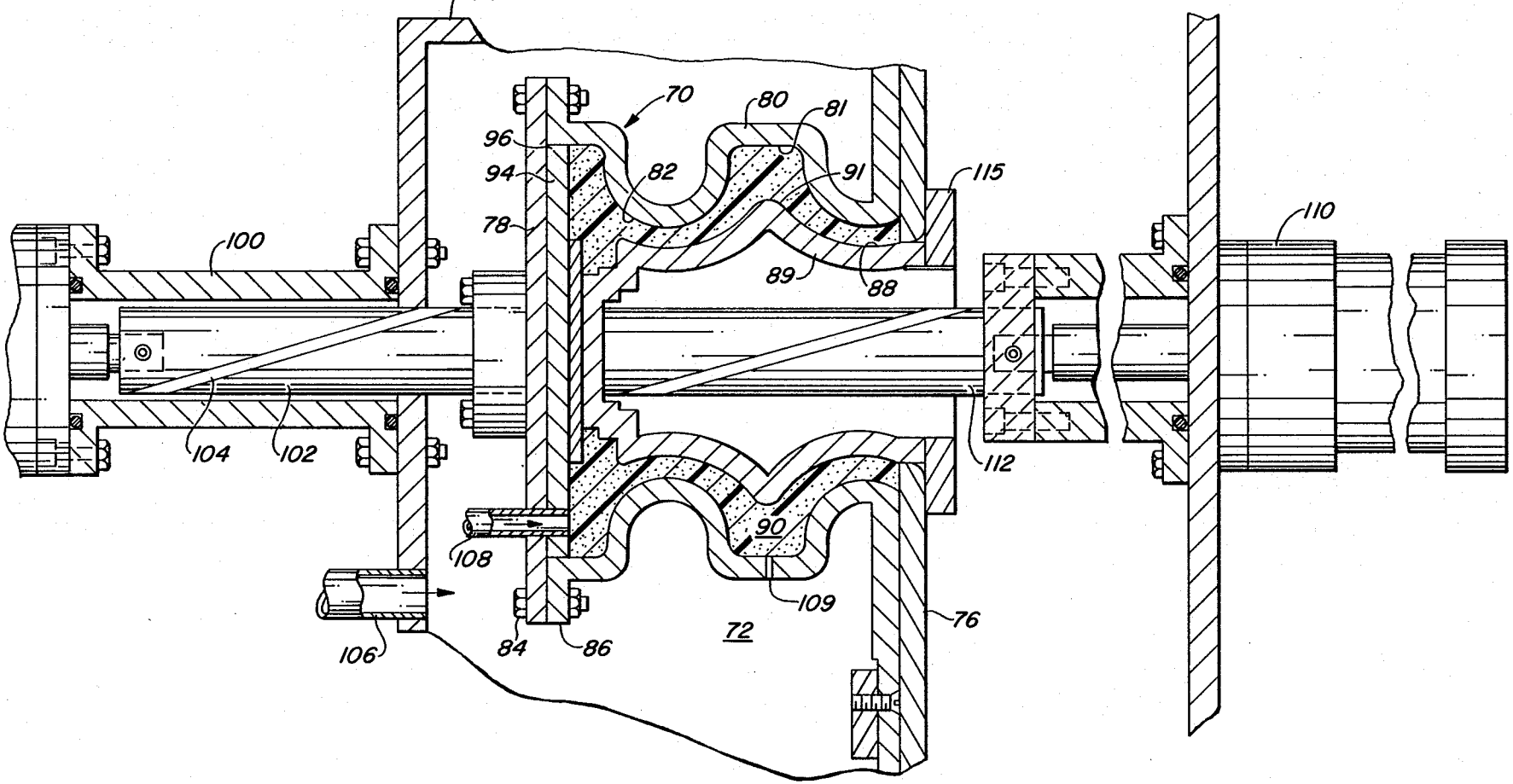
FIG. 9 is a pictorial view showing the molding operation with the expendable pattern casting of FIGS. 5 and 6 in place in a flask.
Figure 10:
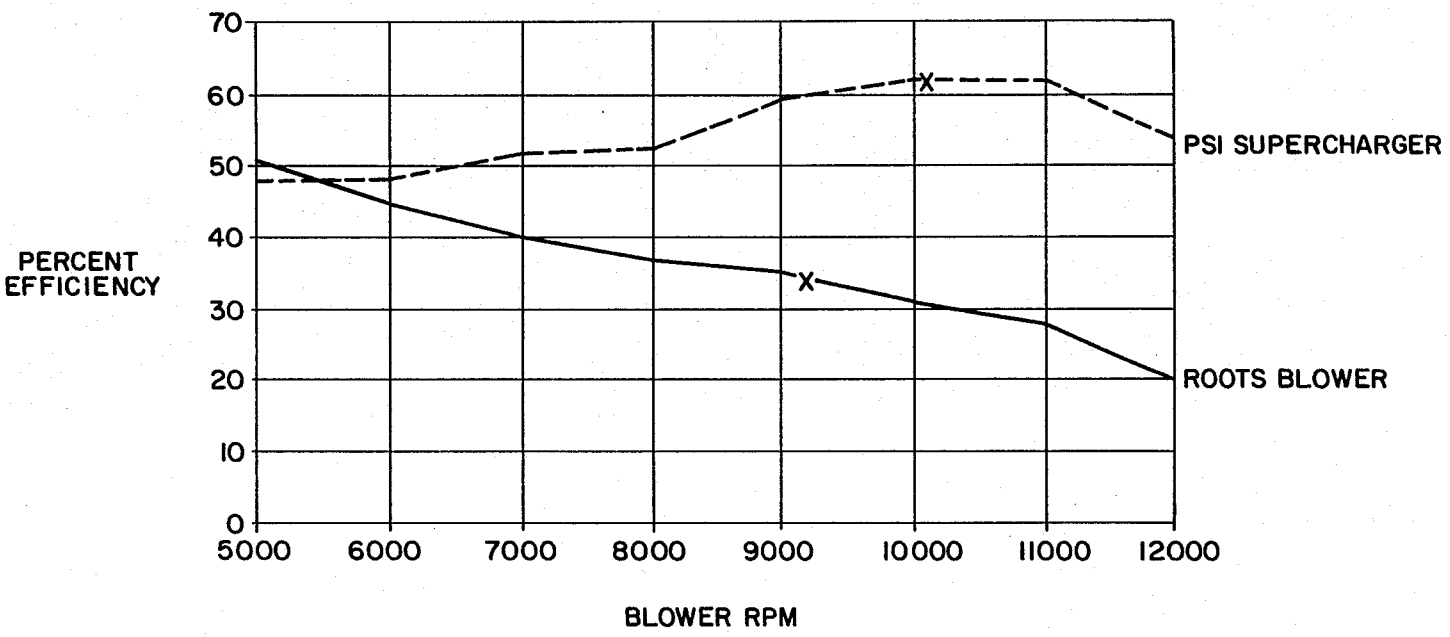
FIG. 10 is a chart comparing the measured efficiency of a unit constructed according to the invention with that of a Roots supercharger.

The male and female rotors 32, 34 of the invention are formed by a process known as lost-foam or expendable pattern casting in contrast to conventional machining and welding techniques. The female foam pattern is shown in FIG. 5. The male pattern is not shown but has an exterior shape identical to rotor 32 with a hollow core. The male and female foam patterns are formed in a metal mold 70 as seen in FIG. 9. The metal mold is enclosed in a steam chest 72 which is defined by exterior wall 74, backplate 76 and front plate 78. FIG. 9 is representative of the pattern making process and illustrates the fabrication of the female rotor pattern. The male pattern is fabricated in the same manner.

Referring again to FIG. 9, the shape of the pattern is established by exterior mold component 80 having helically extending exterior lands and grooves 81, 82, respectively. Mold component 80 is secured to front plate 78 by bolts 84 at radially extending mounting plate 86. Mold core 89 is concentrically positioned within the exterior mold 80 and has a surface 88 spaced from the interior surface of the exterior mold 80 defining the configuration of the completed pattern 90. The surface 88 has helical lands 91 conforming to the helical lands 81 on the exterior mold component.

A pusher plate 94 closes the mold cavity at one end. The pusher plate has projections 96 which conform to the cross-section shape of the female rotor pattern 90. The edges of the pusher plate are angled at the lead angle of the helix so plate 94 may be axially advanced along the outer mold component 80 to force the pattern 90 from the interior and exterior mold components after the core 89 has been helically withdrawn. This is accomplished by a linear actuator 100 which advances screw 102 connected to the pusher plate. The screw is rotated by cam slot 104 having a predetermined lead angle which cooperates with a cam in known fashion. Injection ports 108 are provided in plate 94 for introduction of steam along with vent holes 109 at preselected locations.

The core 89 is connected in a similar manner to linear actuator 110 by a lead screw 112 to cause the core 89 to advance and retract at predetermined rotational and linear rates so the core may be advanced and withdrawn from the steam chest and separated from the molded pattern part 90. A radially extending stop plate 115 is integral with the core 89 to limit the advance of the core into the cavity.

Mold components 80 and 89 are machined to a uniform wall thickness and the helical configuration which is required both for the compressor design and to accomodate helical ejection of the pattern from the mold.

The steam chest 72 is connected to a suitable source of high temperature steam at fitting 106 whch heats the material in the mold cavity. The mold cavity defined by components 80 and 89 define a shape having a uniform and closely controlled thickness with the resulting pattern part 90 having a hollow central interior.

The pattern for the casting process is made from an expandable polymeric material such as polystyrene which under application of moist heat will expand due to the release of pentane. Typically, the beads are initially about 0.02" diameter and their density is approximately 40# per cubic foot. In an initial pre-expansion step, the beads are placed a heated vacuum pre-expander which softens the beads and expands them to a density of approximately 1 to 1.25 pounds per cubic foot.

The pre-expanded material is then ready to be placed into the metal mold cavity. The mold is constructed having passageways connectable to a source of moist heat such as steam. The pre-expanded beads are injected into the mold cavity at the injection ports 108 filling the void between mold components 80 and 89. The polystyrene beads are then expanded under application of hot steam introduced into the steam chest 72 which fuses the beads together into a solid shape creating smooth surfaces on the pattern part 90 as the beads expand against the walls 81 and 91 of the metal mold components. A substantial advantage of the method is that the lift of the mold components 80, 89 is practically unlimited since there is little or no wear on the metal surfaces as the pattern is produced. Vents 109 in the mold allow gases to escape as expansion of the pattern material occurs.

Depending on the size of the pattern 90, the pattern may be molded in one piece or may be molded in several pieces and subsequently joined through the use of cooperative mating features and using suitable adhesives. Similarly, gating runners and risers may be molded as an integral part of the component or may be separately molded and mechanically and/or adhesively attached to the mold. The resulting molded foam pattern 90 is removed or ejected from the mold after a short cooling period and assembled to complete the pattern with attached gating, runners and risers as required. The resulting component is referred to as the foam pattern.

Removal of the pattern from the mold components 80 and 89 is accomplished by operating linear actuator 110 to retract the core. Screw 112 will rotate at a predetermined lead angle to "unscrew" the core 89 from the center of the pattern part. Core 89 is removed rightwardly leaving a hollow interior. Actuator 100 is activated advancing the pusher plate 94 is a rightward direction as seen in FIG. 9 moving the pusher plate in a predetermined angular movement through the outer mold component 80 ejecting the completed pattern part 90 from the mold.

The completed pattern 92 is thus coated with a gas-permeable refractory material. Generally materials of this type are water soluble silicon base refractory materials which may be applied by dipping, brushing or spraying as is known in the art. The high permeability permits the gases or vapors emanating from the polystyrene to escape during the subsequent casting process.

The flask 125 for mold casting is as shown in FIG. 8 and is an open top container of any convenient configuration. The side walls 126 are provided with vents 128 to permit gases to escape from the interior casting chamber 130. The foam pattern 92 is positioned in the open top flask and oriented to provide proper filling and to allow compaction of sand around the pattern. Normally two patterns 90, as seen in FIGS. 5 and 6, will be adhesively joined to form a full-length rotor component. Generally the coated pattern 90 is placed in a vertical position.

A sprue 140 extends upwardly and is connected to the pattern 92 by a horizontally extending runner 136 so that the molten metal fills the area occupied by the pattern 92 uniformly. The location, size and positioning of the sprue, runner and any necessary gating may vary and is well known to those in the molding arts.

The chamber 130 around the pattern 92 is filled with material 142 such as washed and dried silica sand, lake sand or other good quality sand to define the shape of the resulting component when the pattern 92 is expended. Filling of the flask 125 with sand may be augmented by mechanical vibration of the flask to obtain maximum compaction of the sand and to place the sand in intimate contact with the coated pattern.

Pouring occurs in conventional fashion and most ferrous and nonferrous founding metals can be cast by the present method. In the case of high speed hollow rotors, supercharger roots are subjected to high angular accelerations. The preferred foundry metals are alloys of aluminum and magnesium, although the low thermal expansion properties of other metals are better suited to other applications.

The molten metal fills the area defined by the pattern 92 flowing through the runners. The gas pressure developed by the evaporating pattern in contact with the molten metal and the replacement of the pattern by the molten metal prevents collapse of the mold walls. Cooling of the completed casting is followed by shaking out of the casting from the flask. The completed rotor casting is then cleaned and finished. The precision inherent in the casting process permits the rotor blanks to be cast to very near net shape, minimizing the required metal removal during subsequent machining of the rotor profile surfaces. The resulting molded rotor parts, both male and female, are light weight due to hollow construction and the uniform wall thickness.

This precision also permits hollow rotor blanks to be cast with essentially constant wall thickness throughout, thereby providing improved castability over that afforded by solid rotors. In addition to the obvious savings in material costs, the production of lighter weight rotors having a reduced moment of inertia results.

The uniform wall thickness and hollow core of the rotors achieved by the invention is particularly beneficial in process compressors in which the working fluid may not be contaminated by contact with cooling oil which is commonly injected into the compression chambers. Oil or other coolants may be circulated through the hollow rotor interiors to achieve rotor cooling without contacting the working fluid. The uniform wall thickness of the cast rotors provides consistent heat transfer properties which achieves a uniform overall rotor temperature. Internal liquid rotor cooling to achieve temperature control permits the practical operation of rotors having reduced clearances resulting in reduced leakage and improved volumetric efficiency.

EXAMPLE

In order to demonstrate the advantages of the present invention, a supercharger was constructed according to the invention. The supercharger was tested on an engine dynamometer and a comparable Roots supercharger of similar size was also tested. A twenty percent increase in engine power output was achieved. No engine component distress was evident following 39 full-power test runs.

The geometry of the part has been found to be particularly conducive to helically ejecting the foam pattern from the mold. This ejection method may be accomplished by various other combinations of radial, axial and rotory motion of the mold pieces relative to each other and to the foam pattern. Helical ejection is made possible by generating the interior and exterior pattern contours from a series of helical elements each with sufficient draft to permit the foam element to be ejected freely from the mold.

It will be obvious to those skilled in the art to make various changes, alterations and modifications to the helical compressor and method of the present invention. To the extent these changes, alterations and modifications do not depart from the spirit and scope of the appended claims, they are intended to be encompassed therein.

I claim:

1. The method of making rotors for a screw compressor of the type having helical lands therein defining grooves therebetween, said method comprising:

(a) providing a first mold component having a first surface with helically extending lands and grooves;

(b) providing a second mold component having a second surface with helically extending lands and grooves;

(c) concentrically positioning said first and second mold components to define a pattern mold cavity between said first and second surfaces having an exterior surface defined by said first component and an interior surface defined by said second mold component;

(d) filling the mold cavity with expandable polymeric material;

(e) heating the material to expand the material and form a pattern part in the configuration pattern mold cavity;

(f) removing the pattern part from the mold components by imparting a helical motion to the first and second components relative to the pattern part;

(g) placing said pattern part in a flask with a backing material; and (h) pouring molten metal onto the pattern to form a part.

2. The method of claim 1 wherein said polymeric material comprises pre-expanded polyethylene beads.

3. The method of claim 1 wherein said material is heated in a steam chest.

4. The method of claim 1 wherein multiple pattern parts are joined together prior to placing said pattern parts in said flask.

* * * * *